US005524606A

United States Patent [19]

Le Strat

[11] Patent Number: 5,524,606

[45] Date of Patent: Jun. 11, 1996

[54] AIR HEATER

[75] Inventor: Georges Le Strat, Neuilly sur Seine cedex, France

[73] Assignee: Shell Oil Company, Houston, Tex.

[21] Appl. No.: 305,123

[22] Filed: Sep. 13, 1994

[30] Foreign Application Priority Data

Sep. 13, 1993 [FR] France ..... 93 10851

[51] Int. Cl.[6] ..... F24H 3/00

[52] U.S. Cl. ..... 126/99 R; 126/92 C; 126/116 R; 126/110 B

[58] Field of Search ..... 126/99 R, 92 C, 126/116 R, 92 B, 110 B, 91; 431/328, 329

[56] References Cited

U.S. PATENT DOCUMENTS

| | | | |
|---|---|---|---|
| 4,336,791 | 6/1982 | Kitchhen | 126/110 R |
| 4,524,753 | 6/1985 | Wolf et al. . | |
| 4,597,734 | 7/1986 | McCausland et al. . | |
| 4,945,890 | 8/1990 | Ripka . | |

FOREIGN PATENT DOCUMENTS

| | | |
|---|---|---|
| 606935 | 5/1976 | China . |
| 1286008 | 1/1962 | France . |
| 2688298 | 9/1993 | France . |
| 836374 | 8/1958 | United Kingdom . |
| 2167176 | 5/1986 | United Kingdom . |

OTHER PUBLICATIONS

Search Report Jun. 12, 1994.

*Primary Examiner* Larry Jones
*Attorney, Agent, or Firm* Timothy J. Hadlock

[57] ABSTRACT

Air heater comprising a gas burner and heat exchange means including at least one heat-exchange wall which separates a first passage for flow of air to be heated from a second passage for flow of the flue gases produced by the burner, the air to be heated being made to flow by blower means through the first passage, the hot flue gases flowing in counter current through the second passage, wherein the burner is of the radiation type, and the heat-exchange wall comprises a convective-exchange part and an absorption part for absorbing the radiation from the burner, the flue gases heating the air by convection mainly in the region of the convective-exchange part, the radiation from the burner being mainly emitted towards the absorption part, the air flowing over this absorption part after it has flowed over the convective-exchange part.

11 Claims, 2 Drawing Sheets

FIG. 1
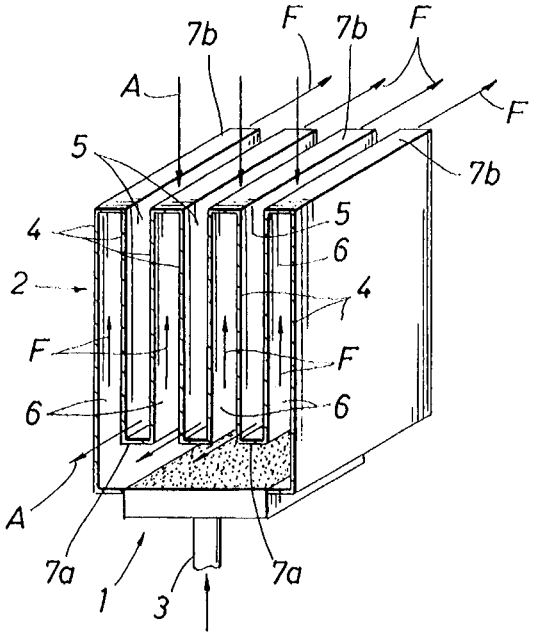
FIG. 2
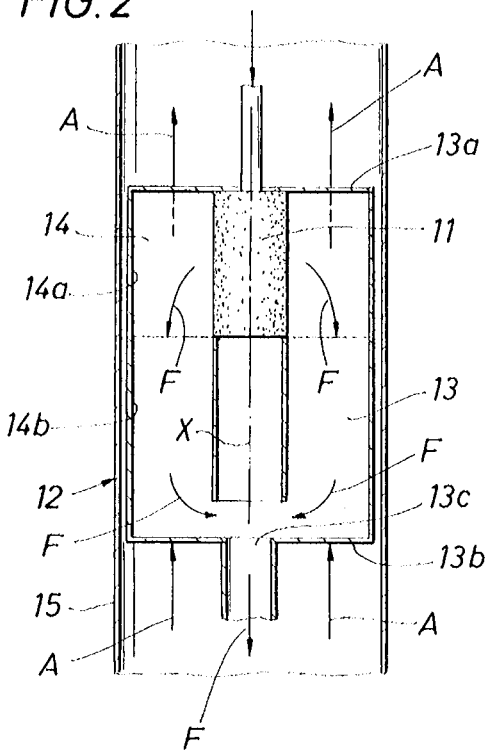
FIG. 3
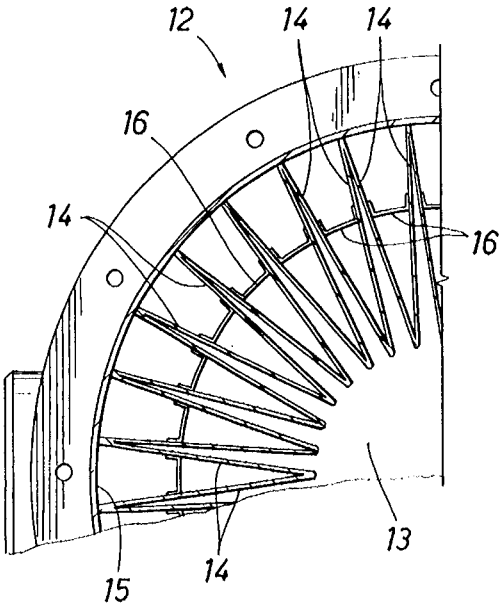
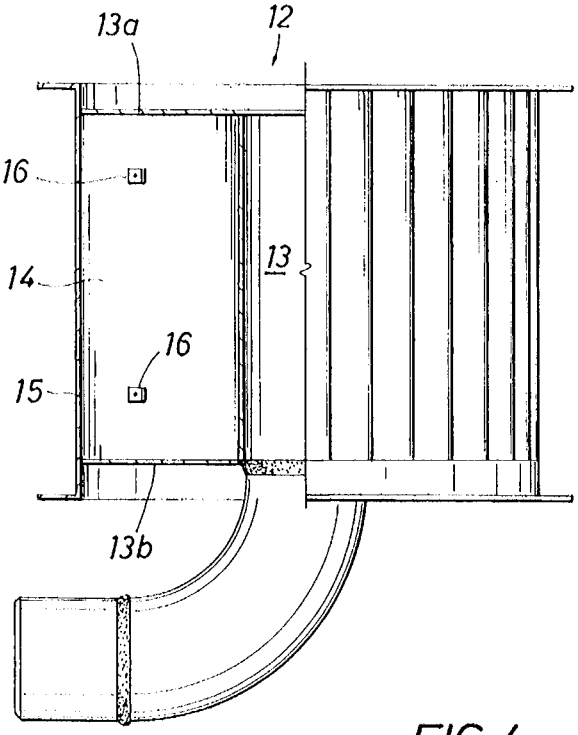
FIG. 4

AIR HEATER

FIELD OF THE INVENTION

The present invention relates to air heaters, and in particular to air heaters for domestic use.

BACKGROUND OF THE INVENTION

Numerous air heaters for domestic use are known, such as hairdryers, hand dryers, linen dryers, etc. These air heaters generally are of low power and operate on electricity.

Gas fired air heaters have been employed for hearing significant volumes, particularly for heating greenhouses or industrial heating.

These gas-fired heaters are of the direct-dilution type or of exchanger type.

In the art of air heating by direct dilution, the combustion gases are diluted into the air to be heated. This technique, which has a high efficiency, is exploited in the heating of greenhouses or some industrial buildings, when the renewal of air is sufficient to accept this technique. In general this technique could not be applied to heat habitable spaces. The renewal of air therein is, for obvious reasons of economy, effectively limited to 1 or 2 volumes/hour.

In heaters with an exchanger, the flue gases heat the air by means of heat-exchange walls, so that there is no direct contact between the flue gases and the air to be heated without any particular precautions. These heaters with an exchanger nevertheless exhibit several drawbacks. They are voluminous and costly and their efficiencies in terms of energy are relatively modes (often close to 70%). Furthermore, these heaters with an exchanger conventionally use blue-flame burners and therefore release significant quantities of nitrogen oxide.

The main objective of the invention is to propose a gas-fired air heater of the type with an exchanger which makes it possible to alleviate the various aforementioned drawbacks. The air heater according to the invention has an improved efficiency and releases only a very low level of nitrogen oxide into the atmosphere.

Also, the heaters with exchangers known to date offer relatively limited regulation possibilities. In effect, any modification of the flow rate of air to be heated may, in principle, be compensated for by a power adjustment of the burner, but the evolution in turbulence and in the convective-exchange coefficients disturbs the response during transient conditions.

More generally, the heating solutions currently known for ensuring hygrothermic comfort prove incapable of withstanding a disturbance. For example, in a dwelling heated by radiators (whether these are electric, or fed with hot water), a modification in reference temperature or external disturbance such as the opening of a door leads to a period during which the reference temperature is not met. Several tens of minutes, even 1 to 2 hours may elapse before the conditions of comfort are restored.

Likewise, the management of smells and of hygrometry is mainly achieved at the expense of thermal comfort.

Another objective of the invention is to propose an air heater which makes it possible to avoid these various drawbacks.

SUMMARY OF THE INVENTION

In accordance with the invention there is provided an air heater comprising a gas burner and heat-exchange means including at least one heat-exchange wall which separates a first passage for flow of air to be heated from a second passage for flow of the flue gases produced by the burner, the air to be heated being made to flow by blower means through the first passage, the hot flue gases flowing in counter current through the second passage, wherein the burner is of the radiation type, and the heat-exchange wall comprises a convective-exchange part and an absorption part for absorbing the radiation from the burner, the flue gases heating the air by convection mainly in the region of the convective-exchange part, the radiation from the burner being mainly emitted towards the absorption part, the air flowing over this absorption part after it has flowed over the convective-exchange part.

BRIEF DESCRIPTION OF THE FIGURES

The invention will be illustrated in more detail, and by way of example, with reference to the accompanying drawings in which:

FIG. 1 shows schematically an air heater with flat burner in accordance with a particular embodiment of the invention;

FIG. 2 shows schematically an air heater with cylindrical burner in accordance with another embodiment of the invention;

FIGS. 3 and 4 are transverse and longitudinal sections, respectively, through the exchanger of the air heater of FIG. 2;

DETAILED DESCRIPTION OF THE INVENTION

Figure 5:
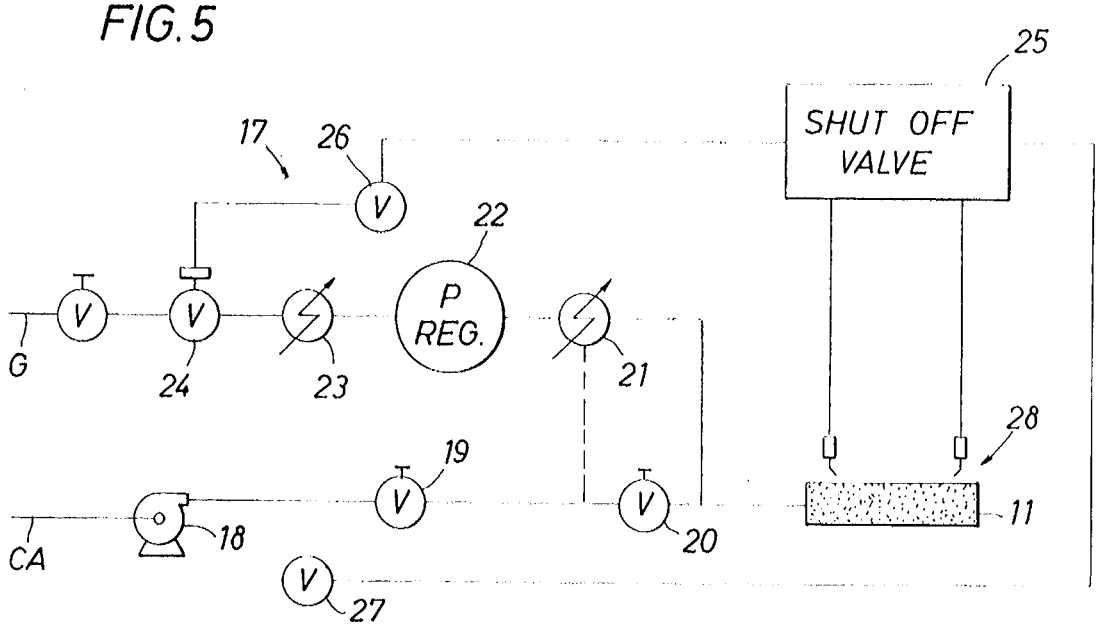
FIG. 5 shows a diagrammatic representation of the circuit for feeding and controlling the burner of the air heater of FIG. 2.

In a preferred embodiment of the invention, the burner is of cylindrical type and is located in the passage for flow of the flue gases, said absorption part facing the burner and said convective-exchange part being located with respect to the longitudinal axis of the burner, beyond the burner on one side thereof, the flue gases emitted by the burner flowing from the burner towards the convective-exchange part.

In particular, the heater in accordance with this embodiment advantageously includes a plurality of first passages for the flow of the air to be heated, said first passages being distributed about the longitudinal axis of the burner.

According to an advantageous embodiment of the invention, the heater includes a plurality of heat-exchange fins defining a star-shaped chamber about the longitudinal axis of the burner, in which chamber the flue gases emitted by the burner flow.

According to another advantageous embodiment of the invention, the first passages for the flow of the air to be heated form tubular passages extending into the second passage for flow of the flue gases parallel to the longitudinal axis of the burner.

According to yet another preferred embodiment of the invention, the burner is of the flat type and the heat-exchange wall includes a plurality of parallel convective-exchange fins together defining an alternating series of first passage for the flow of air to be heated, and second passages for the flow of flue gases, the fins extending substantially perpendicularly to the burner, each pair of successive fins being joined together by a transverse absorption wall parallel to the burner, the transverse walls being located alternately at opposite ends of the fins.

Another subject of the invention is a device for domestic heating, as well as a device for drying individuals, including such an air heater.

DETAILED DESCRIPTION OF THE FIGURES

The air heater of FIG. 1 comprises a burner 1, as well as an exchanger 2.

The burner 1 is a flat radiant burner made up of sintered metal fibers produced from a material marketed under the trade mark FEBRALLOY®. In radiant mode, such a burner has low NOx emission (20 to 40 ppm in stoichiometric combustion compared to 200 to 400 ppm with a conventional burner). Furthermore, such a burner has high mechanical strength which makes it capable of withstanding thermal and mechanical shocks.

In document EP-A-0,157,432, incorporated herein by way of reference, there is described a metal porous fibrous material particularly well suited for the radiant burner of the aforementioned type.

More generally, all ceramic or metal radiant burners with a perforated, porous or fibrous surface can suitably be applied.

The exchanger 2 includes a plurality of flat convective-exchange parallel fins 4 which together define an alternating series of passages 5 for flow of air to be heated and passages 6 for the flow of flue gases. Where fins 4 extend perpendicularly to the plane of the burner 1.

Pairs of successive fins 4 are joined together by transverse walls 7*a*, 7*b* parallel to the burner 1, the walls 7*a*, 7*b* being located alternatively at opposite ends of the fins 4. The walls 7*a* close the passages 5 for flow of air to be heated at the ends of the fins 4 closet to the burner 1 and the walls 7*b* close the passages 6 for flow of flue gases at the ends of the fins 4 furthest from the burner 1.

As illustrated by the arrows A represented in FIG. 1, the air to be heated is introduced into the passages 5 at their open ends opposite the burner 1. They leave these passages 5 laterally, at the end of these passages 5 where the transverse walls 7*a* are located.

As illustrated by the arrows F represented in FIG. 1, the flue gases generated by the burner 1 leave the burner 1 to enter the flow passages 6. They flow therein in the direction indicated by the arrows F and leave these passages 6 laterally at the opposite end of these passages 6 from the burner 1.

The radiation from the burner 1 is essentially absorbed by the transverse walls 7*a*. The Walls 7*a* for this purpose advantageously exhibit a surface in a color which absorbs infrared radiation, for example, a dark matt color.

The air to be heated and the flue gases exchange convectively with the fins 4. Thus, the air introduced into the exchanger 2 is firstly heated by convection in the region of the fins 4. It is then heated just before it leaves the exchanger 2 by the walls 7*a* which have absorbed the radiation from the burner.

It is important for the air not to be heated by the absorption of the radiation until after it has been heated by the heat of the flue gases.

Radiant energy is in fact exchanged as a function of the fourth power of the temperature difference, while convective exchangers are directly proportional to the temperature difference. As a consequence, the energy contained in the products of combustion will be correctly exchanged only if the temperature difference is high enough. It is therefore necessary to prevent the convective-exchange surface of the exchanger from being "preheated" by infrared radiation.

For a typical air heater as has just been described, the overall exchange coefficient of the exchanger 2 is 10 $Wm^2C$ at a power of 30 kW, its exchange surface area being 6.5 $m^2$. The overall efficiency of the exchanger at maximum power is about 80%.

Reference is now made to FIG. 2. The air heater shown in this figure includes a cylindrical burner 11 and an exchanger 12.

The burner 11 is made from the same material as the burner 1. The burner 11 releases 30% of its calorific power in the form of radiation, and 70% of this power in convective form.

The heat-exchanger wall of the exchanger 12 includes a plurality of fins 14 made of refractory stainless steel configured in a star shape about the longitudinal axis X of this burner 11. The fins 14 are parallel to the axis X and together define a star-shaped chamber 13 through which the flue gases flow.

The chamber 13 is closed by two transverse partitions 13*a* and 13*b*. These two partitions 13*a* and 13*b* are flat and are perpendicular to the axis X. Their cut-out has a contour which substantially corresponds to that of the cross-section of the chamber 13.

The radiant burner 11 extends to the chamber 13 from the wall 13*a* towards the wall 13*b*. Its lengthen along the axis X corresponds substantially to one third of the height of the chamber 13. The flue gases flow in this chamber 13 in the way shown schematically by the arrows F. The partition 13*b* is equipped with a circular opening 13*c* to which is attached a pipe for the evacuation of the flue gases.

The air to be heated flows in counter-current from the flue gases, in the direction indicated by the arrows A in FIG. 2, on the other side of these fins 14, in a cylindrical passage 15. This passage 15 is coaxial with the chamber 13. The inside diameter of this passage 15 corresponds to the diameter of the cylindrical envelope of the star shape of these fins 14.

In FIG. 2, those parts of the fins 14 which are located in line with the burner 11 are referenced by 14*a* and these parts of these fins 14 which complement these parts 14*a* are referenced by 14*b*. The radiation emitted by the burner 11 is mainly absorbed by the parts 14*a*. The air which arrives at the exchanger 12 is heated firstly by the parts 14*b* of the walls 14 over which the flue gases exchange by convection. After having passed over these convective-exchange parts 14*b*, the air is heated by the absorption parts 14*a*.

It will be noted that this geometry of the exchanger 12 constitutes a radiation trap in which the infrared radiation is completely absorbed, and that this is true regardless of the emissivity of the surfaces of the fins 14.

With an exchange surface area of 3,4 $m^2$, and at a flow rate of 200 $m^3/h$ and a power of 30 kW, this exchanger offers an overall exchange coefficient of 18 $Wm^2C$.

Reference will now be made more particularly to FIGS. 3 and 4 representing the exchanger 12 in detail.

The chamber 13 of this exchanger includes thirty two branches in the shape of a star, each branch being defined by two walls forming exchange fins 14 which join together in a V. The diameter of the outside envelope of these branches is 390 mm. The diameter of their inside envelope is 140 mm. Between the fins 14 facing each other of two angularly successive branches, there are located two reinforcements 16. These two reinforcements 16 are distributed along the height with respect to the axis X of the exchanger 12. They each have a U-shaped cross-section, the sides of the U bearing on the fins 14 between which they are fitted. Fastening between a reinforcement 16 and a fin 14 is achieved with leaktight rivets.

The cylindrical passage 15 forms a sheet metal barrel to which the ends of the branches are welded.

The fitting of the burner 11 and of the exchanger 12 takes place as follows. Once the fine 14 have been assembled into a star shape, the reinforcements 16 having been fixed to the branches of the chamber 13, the assembly made up of the fins 14 and the reinforcements 16 is inserted into the barrel 15 and the ends of the fins 14 are welded onto this barrel. The cylindrical burner 11 is fitted onto an upper cover intended to constitute the transverse partition 13*a*. The barrel 15 is then closed by this cover 13*a* and also by a lower cover which constitutes the transverse partition 13*b*. The pipe for evacuation of the flue gases and the pipe for feeding with premixed air/gas are then fitted to the covers 13*a* and 13*b*.

Represented in FIG. 5 is the diagram of a device 17 for feeding and controlling the burner 11. The burner 11 is fed with a mixture of air and gas. The device 17 for this purpose comprises an air-feed circuit CA which includes, in series, a blower 18 of the three-phase LEISTER ROBUST 91F type, a manual valve 19 for regulating the maximum air flow rate and a manual valve 20 for regulating the air/gas proportion.

The burner 11 is simultaneously fed with gas through a circuit G which comprises a proportion regulator 21 driven by the air flow rate. The burner 11 is fed in total premix with a minimum air excess of 5%. The regulator 21 is mounted in series with a minimum air excess of 5%. The regulator 21 is mounted in series with a pressure regulator of the Theobald RC 032 type, referenced by 22, a pressure-reducing valve 23 reducing from 1.25 bar to 37 mbar (for propane gas, flow rate 4 kg/h), an electrovalve 24 and a manual shut off valve 25. Also fitted on this burner 11 is a flame controller 25 of the GURTNER type. This controller 25 is connected to a pressure switch 26 which closes the electrovalve 24 as soon as the pressure in the region of the flame controller 25 exceeds 45 mbar. The flame controller 25 is also connected to an air pressure switch 27 detecting the presence of an air flow rate in the region of the burner 11.

Two electrodes 28 controlled by the controller 25 are provided for igniting and controlling the flame of the burner 11.

Figure 6:
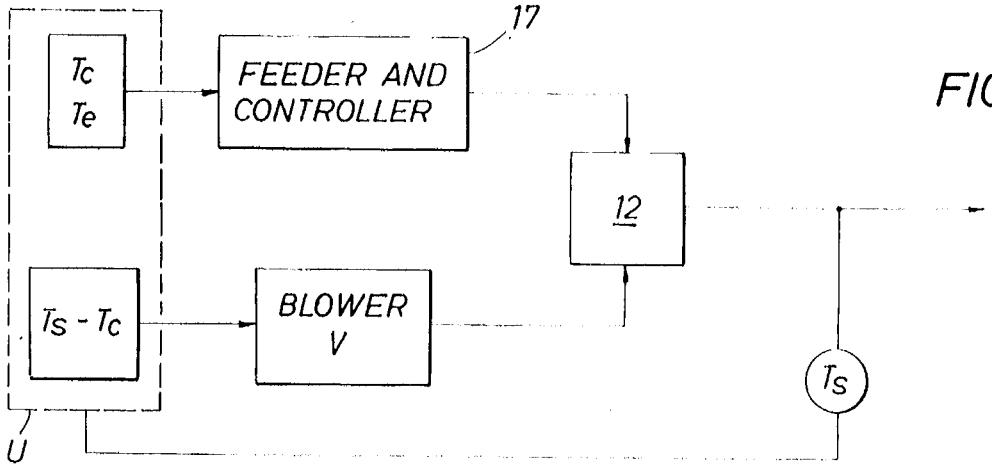
FIG. 6 shows a block diagram illustrating the regulation of the air heater in operation.

The device 17 for feeding and controlling the burner 11, as well as the blower (referenced by V in FIG. 6) by which the air to be heated is induced to flow, are managed by a control unit U, in a regulation loop which has been represented diagrammatically in FIG. 6.

The blower V is advantageously of the "squirrel cage" type. It is powered with a voltage which can vary between the discharge of the blower and the outlet of the heater.

The control unit U is a regulator with a low response time of the PID (proportional-integral-derivative) type. This unit U receives information from sensors which measure the temperatures of the air entering and leaving the heater (Te and Ts, respectively). It acts on the speeds of the blower controlling the air flow rate feeding the burner 11, as well as on the speed of the blower V.

A reference temperature Tc and a flow rate for blowing the air to be heated are initially fixed, either directly by the operator or indirectly as a function of external conditions, by any appropriate automatic means.

As a function of the inlet temperature Te, the regulation loop determine the power P to be provided by the burner to allow the desired temperature Tc to be reached, this power P being given in the conventional way by the formula:

$$P = \frac{\text{flow rate} \times (Tc - Te) \times Cp}{\text{exchange efficiency}} \quad (I)$$

where Cp is the specific heat capacity of the air.

The exchange efficiency is not, however, constant, so that the temperature Tc, effectively reached at the outlet of the heater with the aid of this power P may move away from the reference temperature Tc by a few degrees.

On the basis of the measurement taken of the temperature Ts of the blown air, the unit U determines the difference Tc-Te between the temperature obtained and the reference temperature Tc, then, by means of a closed fine-tuning loop, modifies the flow rate of the air blown by the blower V, until the reference temperature Tc is reached. Thus, it is the modulation of the rotational speed of the blower V which provides the variation in power of the burner (between 10 and 30 kW).

It is important to note that the human body is much more sensitive to a temperature difference than to a difference in flow rate. The modification in the blowing flow rate will pass substantially unnoticed, if the temperature remains stable. Thus, the variation of a renewal of air in an inhabited room from 50 to 100 $m^3/h$ is practically unnoticeable to an individual, which is not the case of a variation in the temperature of the room by 1 or 2 degrees over about ten minutes.

A fine-tuning example is now given.

With the requested flow rate being 1000 $m^3/h$ and the reference temperature 55° C., if the temperature obtained at the outlet of the heater is only 52° C., then the flow rate is reduced to 920 $m^3/h$ so as to bring the temperature closer to 55° C. The air flow rate will be modified until the reference temperature is obtained.

The regulation loop which has just been described therefore makes it possible to give the users of the heater both thermal and hygrothermal comfort.

The regulation means, as well as the device 17 for feeding and controlling the burner, may of course be used for any heater in accordance with the invention.

Figure 7:
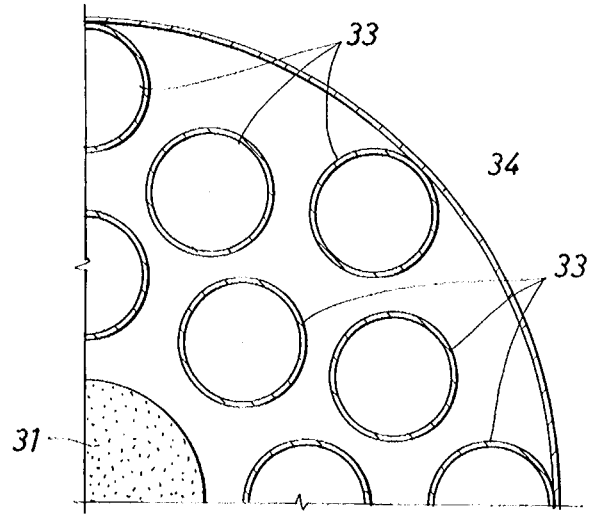
FIG. 7 shows schematically an air heater with cylindrical burner in accordance with another embodiment of the invention.

Other geometries of air heaters with cylindrical burners can also be envisaged. Represented in FIG. 7 is an air heater in accordance with another embodiment which comprises a cylindrical burner 31 and an exchanger which includes a plurality (twenty four) of cylindrical tubes 33 with an inside diameter of 53 mm through which the air to be heated flows. These tubes 33 are located, together with the burner 31, in a cylindrical vessel 34 made of refractory stainless steel, in which they are uniformly distributed about the burner 31.

The air to be heated flows through these tubes 33 in countercurrent to the direction of flow of the flue gases emitted by the burner 31 in the vessel 34. The burner 31 is located facing those parts of these tubes 33 which are furthest from the end of the vessel 34 via which the flue gases escape from the vessel. The radiation emitted by the burner is mainly absorbed by these parts of tubes 33. The air to be heated is, once it has been introduced into the tubes 33, firstly heated by convection by the flue gases emitted by the burner 31, then secondly heated by the radiation energy absorbed by the upper portions of these tubes 33. The internal exchange surface area of the exchanger is 2 $m^3$, and its external exchange surface area is 2.2 $m^2$.

The heaters according to the invention are advantageously used for heating dwellings, or as drying devices (applications to domestic shower rooms, or to communal establishments such as swimming pools, saunas, Turkish baths). In particular, the loop for fine regulation of the heater according to the invention allows the heater to be used to dry the body, as well at swimming pools or health and fitness clubs to at home. Being quicker and more hygienic than the use of towels, such a heater allows thermal equilibrium of the body to be regained quickly after a bath or shower.

What is claimed is:

1. An air heater apparatus comprising a gas burner and heat exchange means including at least one heat-exchanger wall which separates a first passage flow of air to be heated from a second passage for flow of the flue gases produced by the burner, a blower means for making the air to be heated flow through the first passage, the hot flue gases flowing to countercurrent through the second passage, wherein the burner is of the radiation type, and the heat-exchange wall comprises a a plurality of convective-exchange fins each of said fins having two ends and an absorption wall for absorbing the radiation from the burner, wherein said absorption wall joins one end of said convective-exchange fins Wherein the ends of said convective-exchange fins joined by said adsorption wall is disposed proximately to said burner and the opposing end of said convective-exchange fins are disposed distally from said burner, wherein during operation of the air heater the flue gases heat the air by convection mainly in the region of the convective-exchange fins, the radiation from the burner being mainly emitted towards the absorption wall, wherein the convective-exchange fins and absorption wall are disposed in relation to the first passage such that during operation of the air heater, the air to be heated flows over the absorption wall after it has flowed over the convective-exchange fins.

2. The air heater according to claim 1, wherein the burner is of cylindrical type and is located in the passage for flow of the flue gases, said absorption part facing the burner and, said convective-exchange part being located with respect to the longitudinal axis of the burner beyond the burner on one side thereof, the flue gases emitted by the burner flowing from the burner towards the convective-exchange part.

3. The air heater according to claim 2, including a plurality of first passages for the flow of the air to be heated, said first passages being distributed about the longitudinal axis of the burner.

4. The air heater according to claim 3, wherein said plurality of heat-exchange fins define a star-shaped chamber about the longitudinal axis of the burner, in which chamber the flue gases omitted by the burner flow.

5. The air heater according to claim 3, wherein the first passages for the flow of air to be heated form tubular passages extending into the second passages for flow of the flue gases parallel to the longitudinal axis of the burner.

6. The air heater according to claim 1, wherein the burner is of the fiat type and the heat-exchange wall includes said plurality of convective-exchange fins wherein said convective-exchange fins are parallel to one another, said convective-exchange fins and heat-exchange wall together defining an alternating series of first passages for the flow of air to be heated and second passages for the flow of flue gases, the fins extending substantially perpendicularly to the burner, each pair of successive fins being joined together by a transverse absorption wall arranged parallel to the burner, the transverse walls being located alternatively at opposite end of the fins.

7. The air heater according claim 1, further including a management unit and a first sensor for sensing the temperature of the air to be heated, the management unit including means for calculating, as a function of the temperature measured by this sensor and of a reference temperature to be reached, a power to be provided by the burner, and means for controlling the burner so as to deliver said power.

8. The air heater according to claim 7, further including a second sensor for sensing the temperature of the warmed air, and regulating means acting on the blower means in order to correct the flow rate of air to be heated as a function of the difference between the temperature measured by the first sensor and the second sensor.

9. The air heater according to claim 2, wherein the heat-exchange wall is made of refractory stainless steel.

10. The air heater according to claim 1, wherein the burner has at least a power of the order of 30 kW.

11. The air heater according to claim 1, wherein the blower means allow a flow rate of air to be heated of at least 2000 $m^3/h$.

* * * * *